United States Patent [19]

Moser et al.

[11] Patent Number: 4,749,370

[45] Date of Patent: Jun. 7, 1988

[54] CABLE CLAMP FOR AN ELECTRICAL CONNECTOR

[75] Inventors: Jessie L. Moser, Highpoint; Richard L. Hughes, Clemmons, both of N.C.

[73] Assignee: AMP Incorporated, Harrisburg, Pa.

[21] Appl. No.: 414,261

[22] Filed: Sep. 2, 1982

[51] Int. Cl.[4] ..... H01R 13/58

[52] U.S. Cl. ..... 439/460

[58] Field of Search ..... 339/107, 125; 339/103 R, 103 M, 105

[56] References Cited

U.S. PATENT DOCUMENTS

| | | | |
|---|---|---|---|
| 2,920,129 | 1/1960 | Rapata | 174/153 |
| 3,860,318 | 1/1975 | Reavis, Jr. et al. | 339/99 R |
| 4,186,948 | 2/1980 | Cronk | 285/177 |
| 4,231,628 | 11/1980 | Hughes et al. | 339/218 M |
| 4,420,204 | 12/1983 | Leong | 339/107 |

FOREIGN PATENT DOCUMENTS

| | | |
|---|---|---|
| 1171043 | 8/1961 | Fed. Rep. of Germany . |
| 2931331 | 8/1979 | Fed. Rep. of Germany . |
| 1307599 | 12/1961 | France . |
| 93122 | 1/1969 | France . |
| 1551298 | 7/1976 | United Kingdom . |
| 2067365 | 1/1981 | United Kingdom . |

*Primary Examiner*—Gil Weidenfeld
*Assistant Examiner*—P. Austin
*Attorney, Agent, or Firm*—F. Brice Faller; Robert W. J. Usher

[57] ABSTRACT

A cable clamp for an electrical connector in which first and second clamping walls are moved into overlapping relation to deform transversely and trap between them a portion of the cable to be terminated. Cam means urge overlapping portions of the walls together into gripping engagement with the trapped cable portion and cable gripping means insure that cable is only drawn from one direction during clamping to avoid straining the termination.

13 Claims, 5 Drawing Sheets

CABLE CLAMP FOR AN ELECTRICAL CONNECTOR

The invention relates to a cable clamp and particularly to a cable clamp which is suitable for incorporation with an electrical connector housing.

Cable clamps are required for many cable terminations with electrical connector to ensure that stress imposed on the cable is not transmitted to the termination and does not result in deterioration of the electrical connection.

A very wide variety of cable clamps are available, but nevertheless a need exists for a cable clamp which can resist high tensile stress and can easily be assembled by hand with the cable in the field without a requirement for tools. In addition, it is desirable that the cable clamp can accommodate a range of cable sizes to avoid a need to manufacture, store and transport a range of parts, The cable clamp should also comprise a minimum of components each of which can be manufactured using mass production techniques in the interests of economy both of assembly and manufacture. Idealy, the cable clamp should be incorporated by integral constructon with an electrical connector housing for the termination.

It is an object of the inventon to satisfy at least some of the above-mentioned requirements.

According to the invention, a cable clamp comprises first and second clamping members having first and second clamping walls respectively, locatable in laterally spaced, generally parallel relation in a cable receiving condition in which free ends of the walls engage respective axially spaced opposite sides of a cable located between them, cable engaging surface portions of the walls being progressively movable into overlapping relation to deform transversely and trap between them a portion of the cable, means being provided on the clamping members to urge the walls relatively together during such movement into gripping engagement with the trapped cable portion in a clamping condition, and means being provided to secure the clamping members in the clamping condition.

Thus, an operator need merely move the cable clamp to the closed condition to deform a discrete portion of cable to extend transversely of the cable axis and trap that portion between the surfaces of the overlapping walls while those walls are urged together into gripping engagement with the cable, preferably by cam means provided on the clamping members.

An effective clamping action is obtained simple, the wall surfaces providing a large area of contact with the cable to enhance the frictional retention force.

Desirably, the cable engaging surface portion is formed with cable gripping barbs further to enhance the cable retention force. Preferably, the barbs have cable engaging edges facing the free end of the first wall enhancing the retention force in one direction, in practice usually to resist the cable being pulled away from the termination during movement of the cable clamp to the closed condition.

In a preferred embodiment, the cable engaging surface portions terminate at the free ends of the first and second walls in an angular cable gripping edge and a curved sliding surface respectively.

This facilitates bending of the cable to a desired configuration during closure of the clamp, the angular edge tending to crease and retain the cable while the curved surface permits a portion of the cable to be drawn readily into the clamp from a direction remote from the termination. A cable locating lug may also be provided to prevent the cable diverging from a right angle formed by engagement with the edge during closure together of the clamping members.

Desirably, the first clamping member includes a third clamping wall located laterally spaced from and generally parallel to the first wall, the first and third walls upstanding from a common base and the third wall being of less height than the first wall, the second wall being received between the first and third walls in the clamping condition.

Thus, an interdigitating construction is achieved, the reduced height of the third wall providing sufficient clearance for the cable during movement to the clamping condition to enable unimpeded movement of the first and second walls together by the cam means into gripping engagement with the cable.

It is also desirable that interengagable guide means are provided on the first and second clamping members to guide the clamping members together during movement from the cable receiving condition to the cable clamping condition with the second wall nearer to the first wall than to the third wall.

The differential spacing of the walls also ensures sufficient clearance to enable cable to be drawn relatively freely across the third wall during movement of the clamp to a closed condition.

Preferably, the free end of the first wall is formed with an elongate, cable locating recess.

The recess provides additional clearance from the locating lug to enable relatively narrow and thick cables to be accommodated in the recess. Relatively thin and wide cables overlap the longitudinal edge portions of the recess.

The second clamping member may include a fourth wall extending in the same direction as the first wall and having a free end arranged to engage a cable adjacent a free end of the third wall remote from the second wall.

Conveniently, the cam surface is formed by a pair of laterally spaced ears extending from the second wall towards the third wall and defining between them a cable receiving space, the abutment being constituted by a free end of the third wall.

In a particular embodiment, the first and second clamping members are integrally joined respectively to cable receiving ends of base member and cover member of an electrical connector housing, means being provided on the base member to secure an electrical terminal assembly to the base member adjacent a side fo the first wall remote from the third wall.

A particular example of an electrical connector incorporating a cable clamp according to the invention will now be described with reference to the accompanying drawings in which:

FIG. 3 is a cross-sectional view of the connector in a wire-receiving condition;

Figures 4A, 4B, 4C:
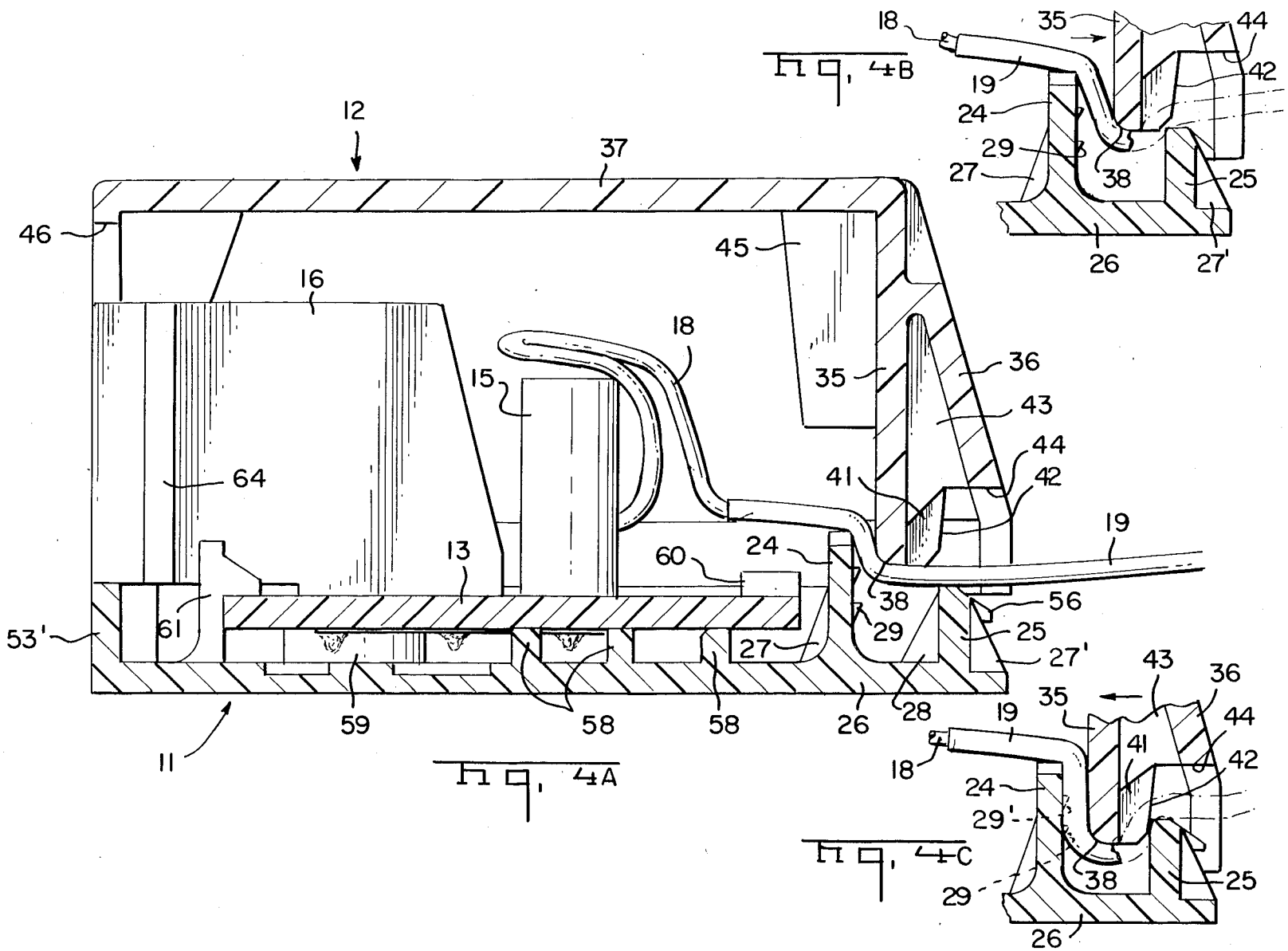
Figure 7:
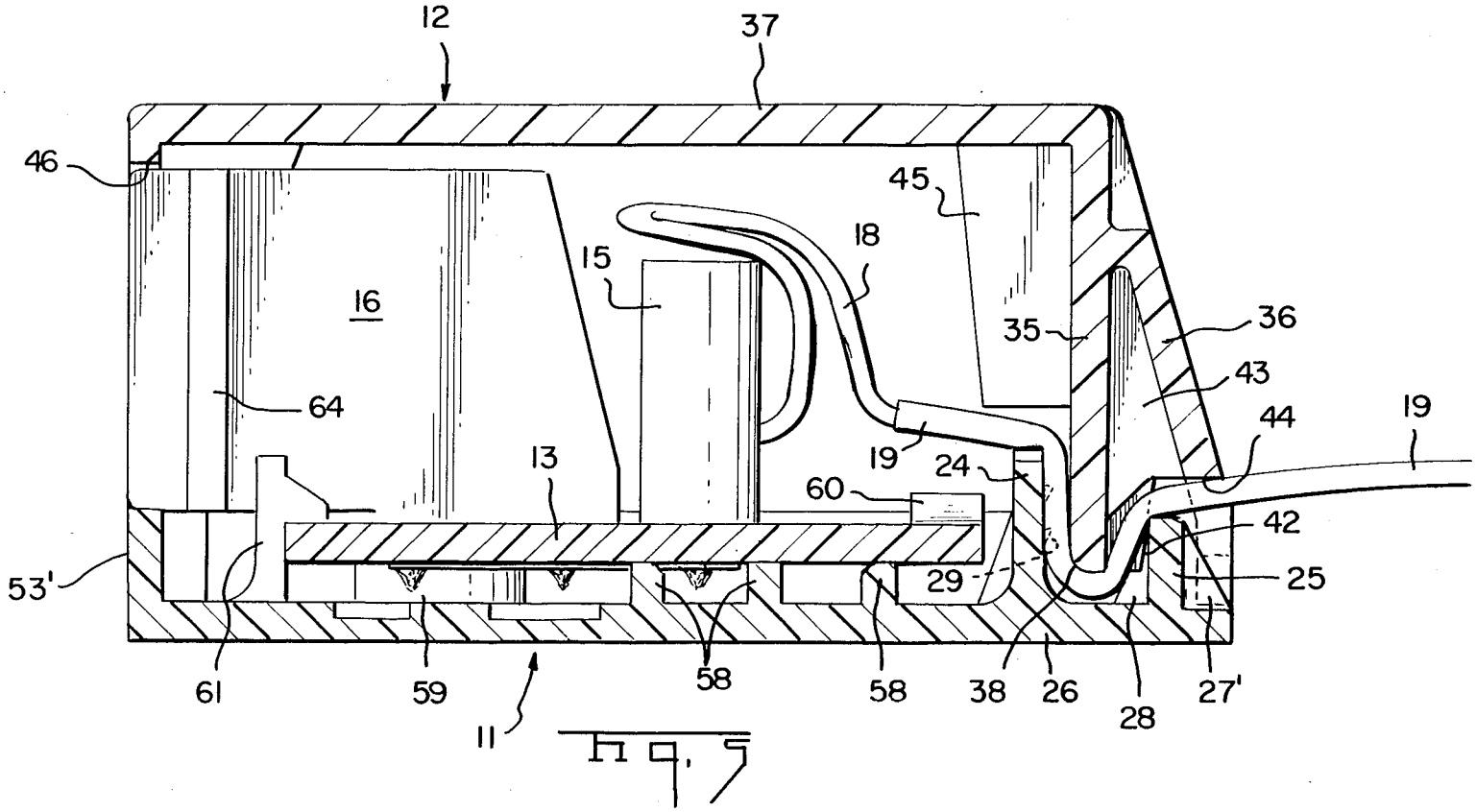
Figure 6:
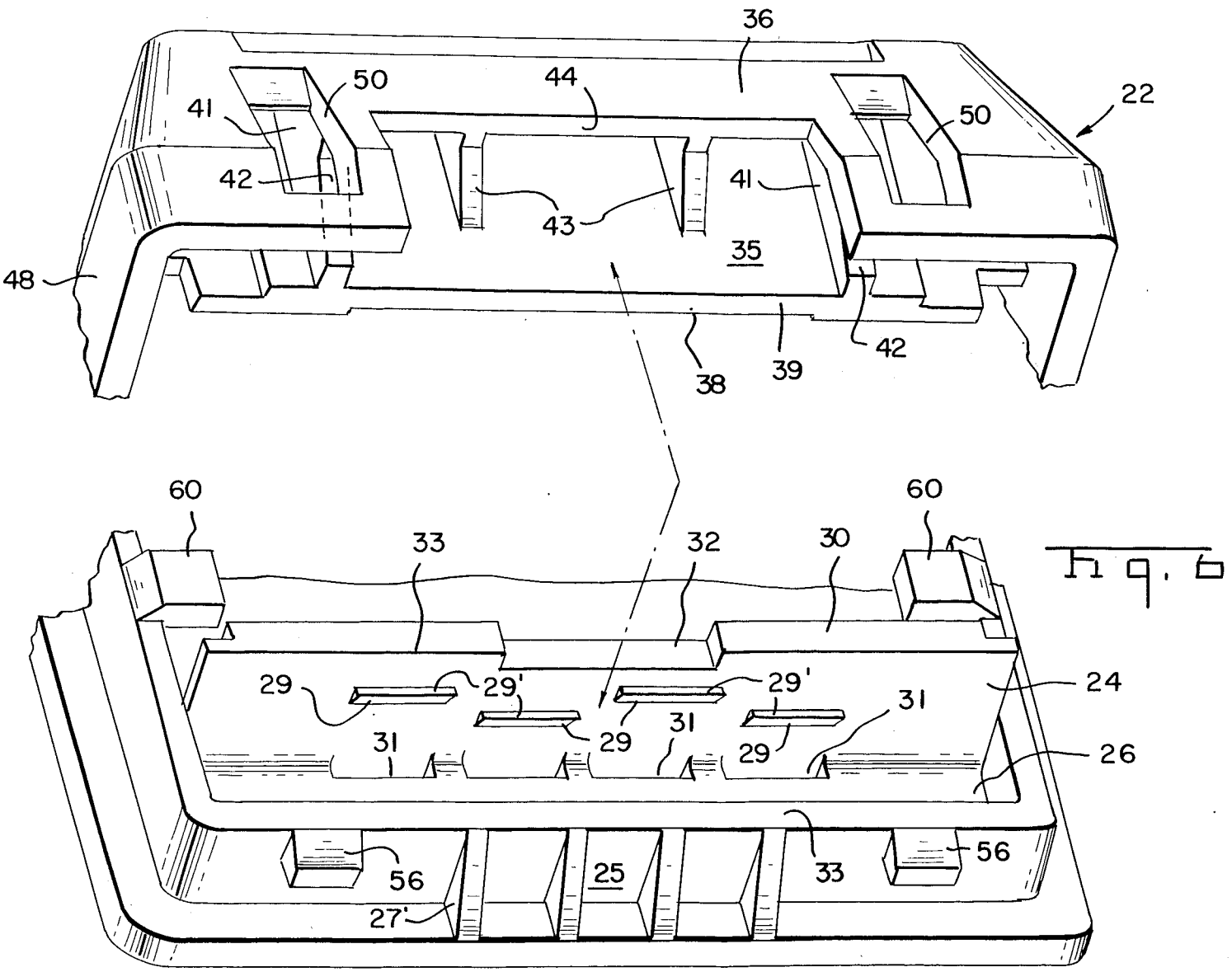

FIG. 4A–C are cross-sectional views of the connector during progressive movement from the wire-receiving condition towards the wire clamping condition;

FIG. 5 is a cross-sectional view of the connector in the fully closed, wire clamping condition; and FIG. 6 is a fragmentary perspective view of cable clamping members of the connector.

The electrical connector comprises a housing including a base member 11 and a cover member 12 each moulded in one piece of plastics material and containing an electrical terminal assembly including a printed circuit board 13 from which upstand slotted barrel, wire receiving terminals 14 similar to those described in U.S. Pat. No. 3,860,318 receiving wire stuffing caps 15 similar to those described in U.S. Pat. No. 4,186,984.

A telephone jack 16 similar to that described in U.S. Pat. No. 4,231,628 is mounted on the printed circuit board adjacent and contact face of the housing with individual contacts electrically connected by the printed circuit board to individual wires 18 of a flat cable 19 terminated by the terminals 14.

The base member 11 and cover member 12 incorporate at wire receiving ends first and second clamping members 21 and 22, respectively. The first clamping member includes first and third clamping walls 24 and 25, respectively, upstanding in spaced apart parallel relation from a base wall 26. Two series of supporting brackets 27, 27' are respectively provided along front and rear faces of respective walls and two supporting brackets 28 are provided on the front of the third clamping wall to each side of a cable engaging end 33. Referring to FIG. 6, a cable engaging portion of the first wall is formed with cable gripping means comprising a plurality of barbs 29 having cable engaging edges 29' facing a free end 30 of the wall. Apertures 31 in the base wall enable the moulding of the barbs 29. The cable engaging surface of the first wall 24 terminates in a cable gripping edge 33 at a cable engaging end 30 which is formed with an elongate cable locating recess 32.

Referring to FIG. 3 second clamping member 22 includes second and fourth clamping walls 35 and 36 depending from a top wall 37 of the cover member. The second wall 35 depends perpendicularly from the top wall located in laterally spaced, parallel relation to the first wall 24 in the operative condition of the clamping members and terminates, at a free cable engaging end 39, in a curved sliding, cable engaging, surface 38.

Cam members 41 extend between the second and fourth walls 35, 36 and are provided with camming surfaces 42 towards a wire receiving end. Spaced supporting brackets 43 also extend between the second and fourth walls adjacent a cable receiving rebate 44 in the fourth wall.

Figure 1:
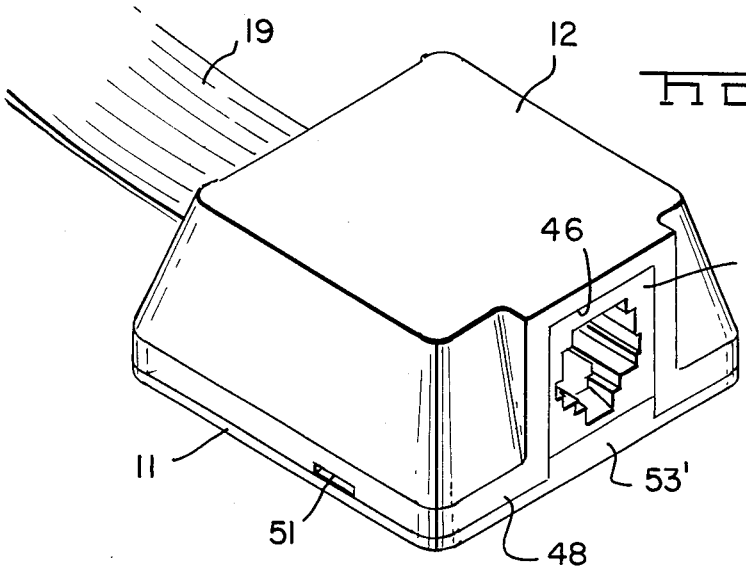
FIG. 1 is a perspective view of the connector terminating a ribbon cable.
Figure 2:
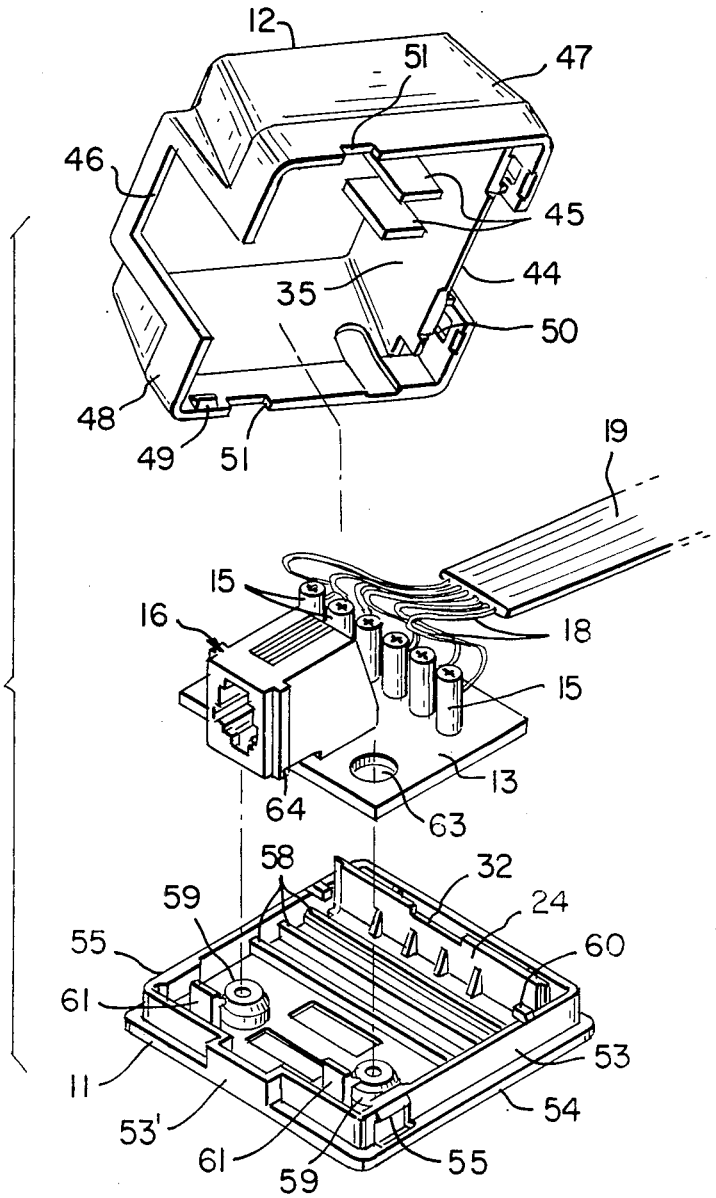
FIG. 2 is an exploded perspective view of the connector.
Figure 7:
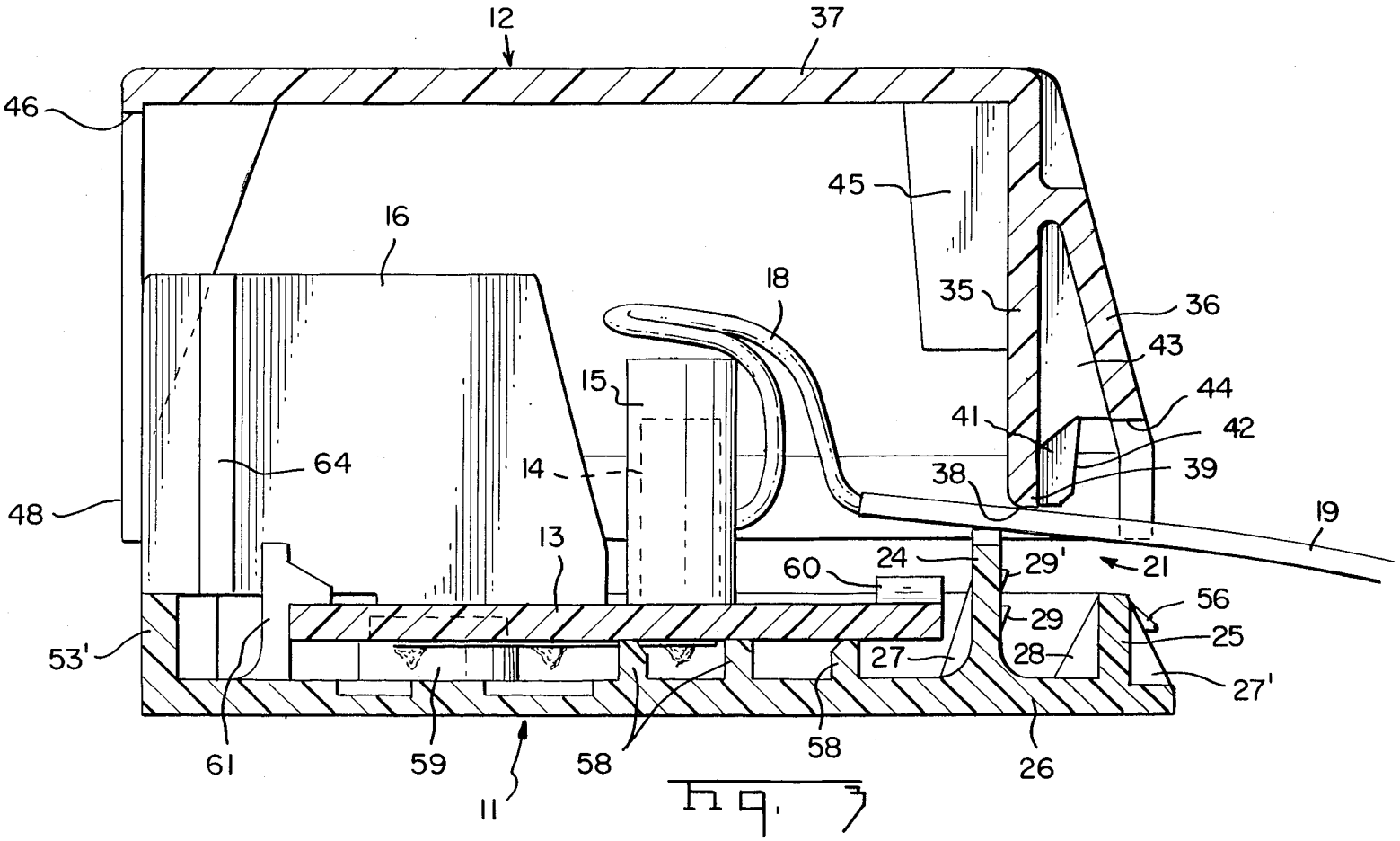

Referrring to FIG. 1, a pair of spaced apart cable locating lugs 45 extend between the top 37 and second wall 35 of the cover. A side wall 47 of the cover is formed at a contact end of the connector with an opening 46 and at free ends with a peripheral skirt 48 joining the fourth wall 36 at the contact end of the connector. Latching detents 49 and eyes 50 are provided on the interiors of the opposite sides of the skirt and at the junction of the fourth wall and the skirt on each side of the cable receiving opening 44. A release tool receiving cut out 57 is formed on the free end of the skirt on each side of the connector.

The base member is formed with a side wall 53 upstanding and inset from the periphery of the base wall 26 to a provide peripheral cover locating seat 54. A portion 53' of the side wall projects to the contact face of the base member. Latching recesses 55 and catches 56 are provided on opposite external sides of the side wall 53 and on the third wall 25 which is coextensive with the side wall 53.

Supporting ribs 58 extend in spaced parallel relation across the base wall 26 and a pair of locating bosses 59 upstand in spaced apart relation from the base wall adjacent the contact face. Terminal assembly retaining catches 60 extend inwardly from opposite free ends of the side wall 53 adjacent the first wall 24 for cooperation with a pair of resilient latches 61 which upstand from the base wall in spaced apart relation.

The printed circuit board 13 is formed with boss-receiving apertures 63 and the telephone jack is formed on opposite sides with a vertically extending, cover locating, ribs 64.

In operation, the terminal assembly is mounted in the base member by one end of the printed circuit board being received under the two catches 60 and the other end being subsequently received as a snap fit by the latches 61, the apertures 63 registering with the bosses 59. The individual wires 18 may be stuffed into the terminals 15 using the technique described in U.S. Pat. No. 4,186,984 prior or subsequent to mounting the terminal assembly in the base member.

The cover member is then aligned with the base member with the cable dressed over the first and third clamping walls on the base member as shown in FIG. 3. Pressing the cover on to the base causes the free end of the second, clamping wall 35 to deform a discrete portion of the cable to extend transversely of the cable axis and draw more cable from the exterior of the connector as shown in FIGS. 4A–4C. The cable is held by the relatively sharp edges 33 of the first wall 24 and slides across the surface 38 of the second wall 35 during such movement. Any tendency for the cable to pivot away from the edge 33 will be prevented by engagement ultimately with the cable locating lugs 45. Engagement between the skirt 48 on the cover member 12 and the upstanding base wall 53 and the skirt and the ribs 64 will assist in guiding the first and second clamping walls 24, 35 respectively together into parallel relation interdigitating with the third and fourth walls 25, 36 respectively.

It should be noted that, as indicated in FIG. 4B, the second wall 35 will tend to move away from the first wall 24 during initial closure together of the clamping members until cam surface 42 engages the free end of the third wall 25 urging the second wall 35 back towards the first wall 24 until the transversely deformed portion of the cable 19 is gripped by the first and second walls 24, 35 as shown in FIG. 4C. The barbs 29 assist in restraining the cable from being drawn away from the terminals during the latter stages of movement to the closed condition. Latching detents 49 and eyes 50 on the cover member and the recess 55 and catches 56 on the base member snap into engagement in the fully closed condition shown in FIG. 5.

Repeated release and effective clamping of the cable may be easily achieved enabling the individual wiring pattern to be altered in the field.

We claim:

1. A cable clamp comprising first and second clamping members having first and second clamping walls respectively, locatable in laterally spaced, generally parallel relation in a cable receiving condition in which free ends of the walls engage respective axially spaced opposite sides of a cable located between them, cable engaging surface portions of the walls being progressively movable into overlapping facing relation to deform transversely and trap between them a portion of the cable, means being provided on the clamping members to urge the cable engaging surface portions of the walls relatively together during such movement into gripping engagement with the trapped cable portion, in a clamping condition, and means being provided to secure the clamping members in the clamping condition.

2. A cable clamp according to claim 1 in which the means to urge the walls relatively together comprise a cam surface on one clamping member engageable with an abutment on the other clamping member during such movement.

3. A cable clamp according to claim 2 in which the cable engaging surface portion of the first wall is formed with cable gripping means.

4. A cable clamp according to claim 3 in which the cable gripping means comprise a plurality of barbs having cable engaging edges facing the free end of the first wall.

5. A cable clamp according to claim 3 in which the cable engaging surface portions terminate at the free ends of the first and second walls in an angular cable gripping edge and a curved sliding surface, respectively.

6. A cable clamp according to any one of claims 1 to 5 in which the first clamping member includes a third clamping wall located laterally spaced from and generally parallel to the first wall, the first and third walls upstanding from a common base and the third wall being of less height than the first wall, the second wall being received between the first and third walls in the clamping condition.

7. a cable clamp according to claim 6 in which interengagable guide means are provided on the first and second clamping members to guide the clamping members together during movement from the cable receiving condition to the cable clamping condition with the second wall nearer the first wall than the third wall.

8. A cable clamp according to claim 6 in which the second clamping member is provided with a cable locating lug aligned with and spaced apart from the free end of the first wall to define a cable confining space which decreases in size as the first and second walls are moved into overlapping relation.

9. A cable according to claim 6 in which the free end of the first wall is formed with an elongate cable locating recess.

10. A cable clamp according to claim 6 in which the second clamping member includes a fourth wall extending generally parallel to the first wall and having a free end arranged to engage a cable adjacent a free end of the third wall remote from the second wall, the third wall being received between the second wall and the fourth wall.

11. A cable clamp according to claim 10 in which the fourth wall diverges from the second wall as it extends from a root end to the free end.

12. A cable clamp according to claim 6 in which the means to urge the first and second walls together comprises cam surfaces formed by a pair of laterally spaced cam members extending from the second wall towards the third wall and defining between them a cable receiving space, the cam surfaces cooperating with a free end of the third wall to urge the second wall toward the first wall.

13. A cable clamp according to claim 6 in which the first and second clamping members are integrally joined respectively to cable receiving ends of a base member and a cover member of an electrical connector housing, means being provided on the base member to secure an electrical terminal assembly to the base member adjacent a side of the first wall remote from the third wall.

* * * * *